United States Patent [19]

Boyce et al.

[11] Patent Number: 4,837,900

[45] Date of Patent: Jun. 13, 1989

[54] POCKET CLIP ASSEMBLY AND ASSEMBLY METHOD

[75] Inventors: Stephen V. Boyce, North Scituate; Robert V. Lozeau, Cumberland; Lawrence R. Farmer, Barrington, all of R.I.

[73] Assignee: A.T. Cross Company, Lincoln, R.I.

[21] Appl. No.: 182,854

[22] Filed: Apr. 18, 1988

[51] Int. Cl.[4] ..... B43K 25/00

[52] U.S. Cl. ..... 24/11 P; 401/98; 401/202; 401/243

[58] Field of Search ..... 401/104, 131, 243, 61, 401/98, 124, 202, 247, 262, 269; 24/11 R, 11 M, 11 P, 12, 11 C, 11 HC

[56] References Cited

U.S. PATENT DOCUMENTS

| | | | |
|---|---|---|---|
| 863,029 | 8/1907 | Holland | 24/11 P |
| 883,767 | 4/1908 | Watts | 24/11 P |
| 884,865 | 4/1908 | Sands | 24/11 P |
| 1,863,016 | 6/1932 | Krause | 24/11 P |
| 2,541,855 | 2/1951 | Bauer | 24/11 P |

FOREIGN PATENT DOCUMENTS

| | | | |
|---|---|---|---|
| 970151 | 1/1951 | France | 24/11 P |
| 418608 | 2/1947 | Italy | 24/11 P |
| 853896 | 11/1960 | United Kingdom | 24/11 P |

*Primary Examiner*—Richard J. Apley
*Assistant Examiner*—David J. Bender
*Attorney, Agent, or Firm*—Colucci & Umans

[57] ABSTRACT

A pocket clip assembly for a writing instrument includes a pocket clip partially extended into a cap of the writing instrument and pivotable about a ring which is embedded within a plastic insert fixed to the cap. The assembly technique includes steps for presassembling the components of the cap assembly prior to embedding the ring into the plastic insert.

21 Claims, 11 Drawing Sheets

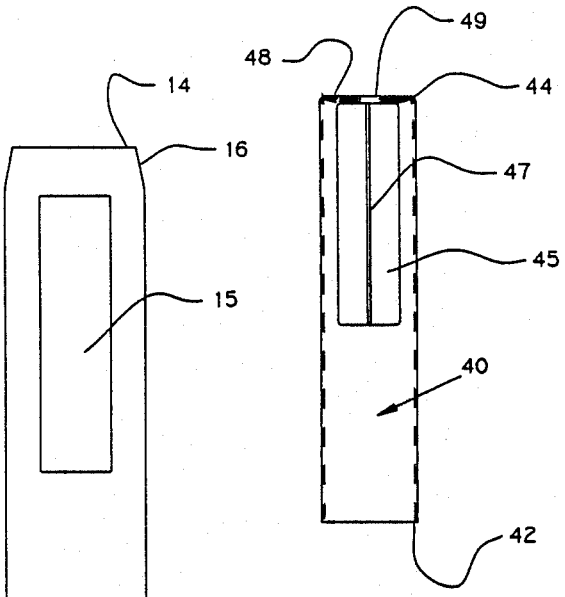
FIG. 7
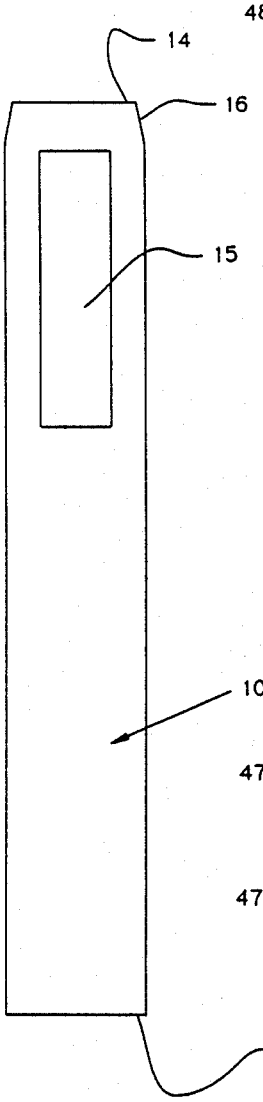
FIG. 6
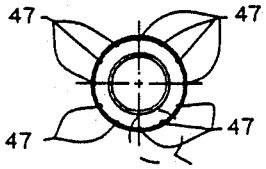
FIG. 8
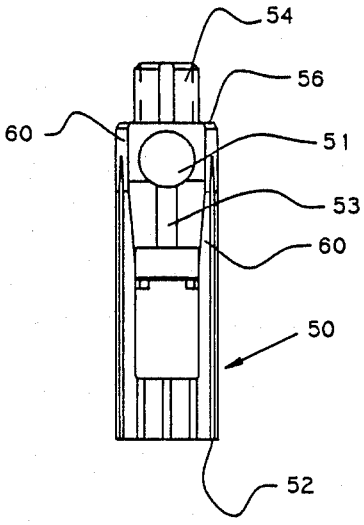
FIG. 9
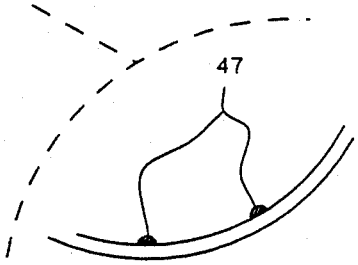

POCKET CLIP ASSEMBLY AND ASSEMBLY METHOD

BACKGROUND OF THE INVENTION

The present invention relates to writing instruments and, more particularly, to a new and improved cap assembly with an adjustable pocket clip mechanism for a writing instrument and a method of assembling the assembly.

Pocket clips are conventionally rigidly secured to the cap or barrel of a writing instrument in cantilevered fashion to provide a means for conveniently holding and positioning the writing instrument within a shirt or coat pocket. Such clips are often a relatively thin, flexible metallic or plastic strip that may be bent away from the body of the writing instrument through a limited distance of sufficient clearance to allow fabric to pass between the clip and the body without damage.

Finer quality writing instruments not only serve functional writing purposes but are designed to also provide a stylish appearance which, like jewelry, can act as a clothing accessory that highlights and compliments personal dress and appearance. One drawback associated with the use of conventional pocket clips occurs where, for example, it is desired to hold the writing instrument in an outer pocket made of a thick fabric, for example, for a winter-weight, tweed sports coat. Due to the relatively greater thickness of such fabrics, conventional clips may become permanently distorted and fatigued or stressed beyond their elastic limit and broken when clipped to such apparel. The problem is more exasperated in the case of clips which have a relatively square cross-section and, thus, less spring or flexibility and cannot be readily bent away from the body of the writing instrument.

A moveable clip for a writing instrument that could accommodate both thin and thick fabrics and which is amenable to mass production without sacrificing aesthetic or functional quality is very desirable.

The patent literature discloses some writing instruments which include clip structures that are generally moveable about a pivot point.

Rudimentary designs of moveable clips are disclosed by U.S. Pat. Nos. 1,339,359 and 1,863,016. More detailed constructions are also known.

U.S. Pat. No. 1,808,045, for example, discloses a structure, characterized as being adapted to be readily and quickly applied to a tubular member, in which the clip is pivotally mounted within a slot formed in a fountain pen cap or pencil barrel. Other moveable clips found in the patent literature perform functions, like retracting or extending a writing point, see for example U.S. Pat. Nos. 3,075,496 and 4,551,034.

The foregoing disclosed constructions, however, would not be suitable for clips of substantial cross-section or for reliable and consistent precision mounting of clips to multiple interconnected parts wherein cumulative size tolerances can provide significant variations in the relative locations of one or more of the parts and pivot point.

SUMMARY OF THE INVENTION

The present invention is directed to an improved cap assembly for a writing instrument with a pivotable clip and a method for assembling the assembly that is suited for mass production without sacrificing aesthetic or functional quality.

The cap assembly of the invention includes a spring loaded clip with a bottom projection at its top end that projects into a slot extending through the cap. Within the cap, the bottom of the bottom projection of the clip is provided with a hook that is engaged around a pivot ring in the cap. The pivot ring is set into a plastic pivot insert which, in turn, is located within a metallic, ribbed sleeve press fitted into the cap. A compression spring is transversely seated within a hole in the pivot insert and bears against a flat formed on the bottom of the bottom projection at a position intermediate to the hook and the top end of the clip. The clip is designed to be pivoted about the pivot ring by depressing the top end portion of the clip into the cap against the spring, thereby compressing the spring and causing the lower end of the clip to move away from the cap. The compressed spring resiliently urges the top end to a neutral position in which the clip is essentially parallel to the cap. The pivot action permits the clip to be easily engaged and disengaged to a thick garment without damaging the clip or garment.

The pivot ring is preferably fixed to the pivot insert by ultrasonic insertion.

The method of assembling the cap assembly includes the steps of inserting a ribbed sleeve into the bore of the cap and press fitting the sleeve to the cap with the rectangular cutout thereof in transverse alignment with the rectangular slot of the cap. Next, the pivot insert is mounted into the bore of the sleeve and the axial slot of the insert is transversely aligned with the slots of the cap and sleeve. The pivot insert is fixed relative to the cap by attachment of a top to a portion of the insert which extends through the open upper ends of the cap and sleeve. The clip is then mounted onto the outside of the cap with the projection and hook being inserted into the cap. The hook is located in the axial slot and the clip is precisely located. A pivot ring is then axially inserted into the hook groove in abutment with a portion of the insert. The ring is ultrasonically welded to embed it into the pivot insert material until the ring is fully received in the hook groove.

In accordance with the inventive construction, a writing instrument cap assembly is provided with a rigid bar-type pocket clip which is pivotable about a pivot point that is hidden from view thereby advantageously enhancing the appearance of the assembly. The inventive construction and assembly technique also advantageously allow precise location of the clip so that the clip can be pivotably actuated within a slot in the tubular cap without rubbing against the sides of the slot thereby avoiding the creation of wear marks and avoiding the interference with the smoothness of the pivoting operation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, forming a part of this specification, and in which reference numerals shown in the drawings designate like or corresponding parts throughout the same.

FIG. 6 is a front elevational view of the cap of FIG. 1;

FIG. 7 is a front elevational view of a ribbed sleeve which forms a part of the assembly of FIG. 1;

FIG. 8 is an end view of the lower end of the ribbed sleeve of FIG. 7;

FIG. 9 is a front elevational view of a pivot insert which forms part of the assembly of FIG. 1;

DETAILED DESCRIPTION

Figure 1:
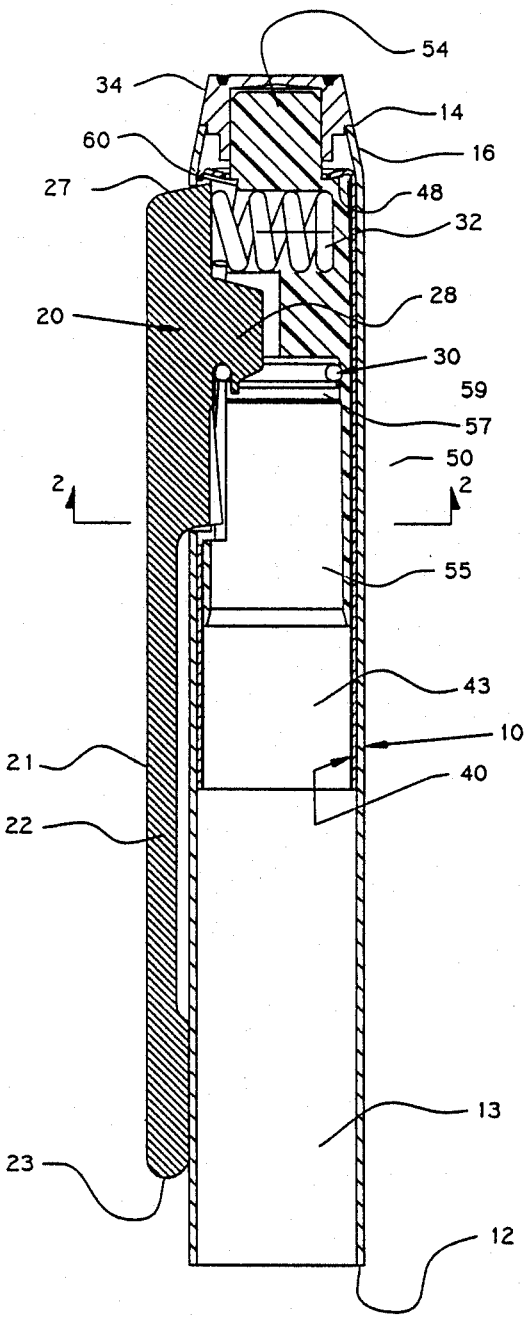
FIG. 1 is an elevational view, partially in section, illustrating a writing instrument cap assembly with an adjustable pocket clip according to the invention.
Figure 2:
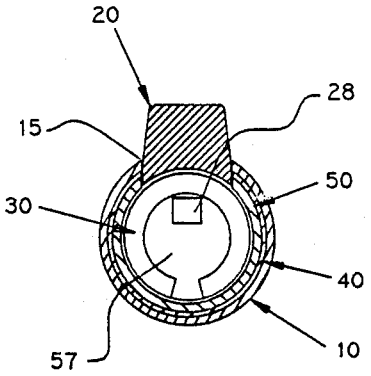
FIG. 2 is a view of the assembly of FIG. 1 taken along view lines 2—2.

FIG. 1 illustrates a writing instrument cap assembly, according to the invention, which includes a cylindrical cap 10, a pocket clip 20 that is partly extended through a slot 15 in the cap 10 and engaged with a pivot ring 30 seated within a pivot insert 50 which, in turn, is press fitted into a ribbed sleeve 40 mounted within the cap 10.

Figure 4:
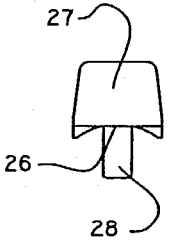
FIG. 4 is an end view of the upper end of the clip of FIG. 3.
Figure 3:
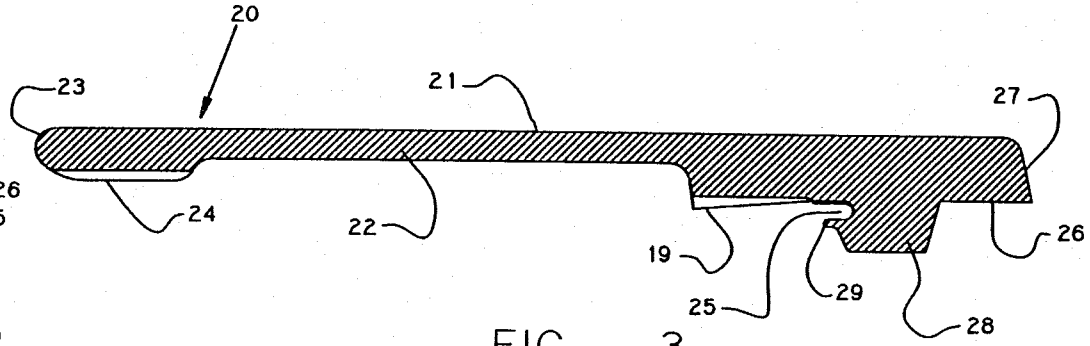
FIG. 3 is a longitudinal cross section of the clip of FIG. 1.
Figure 5:
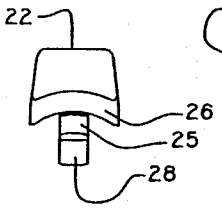
FIG. 5 is an end view of the lower end of the clip of FIG. 3.
Figure 10:
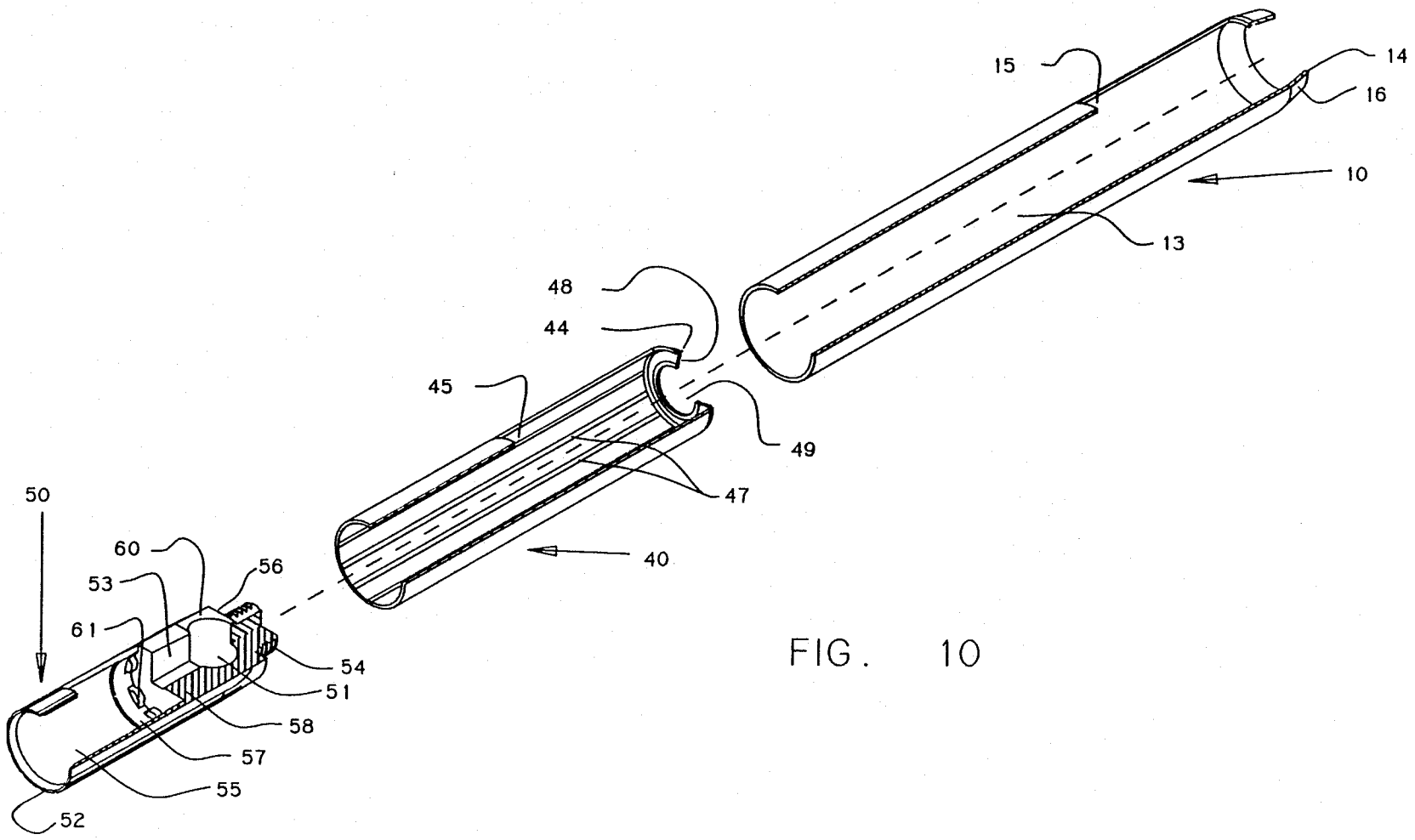
FIG. 10 is longitudinally exploded view illustrating the arrangement of the cap, the ribbed sleeve and the pivot insert of FIGS. 6, 7 and 9, all of which are partially broken away to more clearly illustrate their internal surfaces.

The pocket clip 20, as shown by FIGS. 3 through 5, comprises an externally-disposed elongated arm 22. An inwardly directed stop 24 is located on the bottom or inner surface of the clip 20 adjacent to the rounded lower end 23 of the arm 22. The stop 24 has a arcuate inner surface complementary to the outside surface of the cap 10, i.e., which is designed to parallel the circular contour of the outer surface of the cap 10 to provide increased pocket cloth contact surface. The arcuate inner surface shape of stop 24 also causes the cloth engaged by the clip to conform to the arc, thus creating greater side-to-side retention and, as well, extra retention force for clipping the writing instrument to the pocket. A rectangular bottom projection 26 is integrally formed along a portion of the bottom or inner surface of the clip 20 adjacent to the upper end 27 of the arm 22. The upper end 27 of the clip 20 is slanted at an angle greater than ninety-degrees relative to the substantially planar outer surface 21 of the clip. The edge between the upper end 27 and the outer surface 21 is rounded. A pivot engaging piece, hook 28, protrudes from the bottom of the bottom projection 26. The hook 28 includes a hinge groove 25, opened toward the lower end 23 of the clip 20, for receiving a portion of the pivot ring 30. The hook 28, as seen in FIGS. 4 and 5, has a width, measured side-to-side, which is less than that of the remaining portions of the clip. The central portion of the arm 22 intermediate to the stop 24 and bottom projection 26 has a generally rectangular cross-section with a width that is greater than its thickness. The bottom portion of the clip that includes the projection 26 has a generally square cross-section except at the hook. A lip 29 is formed at the tip of the hook 28. The lip is mechanically deformable.

As best shown by FIG. 6, the cap 10 is a tubular body in the form of a circular cylinder, preferably a thin metal cylinder. The cap 10 has an axial bore 13 longitudinally extending between two opposite open ends, lower end 12 and an upper end 14 at the end of a tapered, frusto-conical upper end portion 16 of the cap. A longitudinally-extending rectangular slot 15, adjacent to the upper end portion 16, extends from the outside surface through the side wall of the cap 10 to the inside surface. The slot 15 is sized to receive the bottom projection 26 and the hook 28 of the clip 20, which project into the bore 13 of cap 10 from the outside, as shown in FIG. 1, as well as to accommodate pivotal movement of the clip 20 relative to the cap 10 and to allow lateral installation of the compression spring 32, as described hereafter. Skirts 19 are formed along the lower edge of the forepart of each side of the projection 26 with sufficient length so that a foreportion of the projection always remains within the rectangular slot 15. The wall slot as illustrated in the preferred embodiment is a rectangular slot 15. Alternatively, other slot shapes with parallel sides could be used and, it should be understood, that slots with curved, non-parallel edges with proper matching clip geometry could provide equivalent acceptable functions.

The ribbed sleeve 40 comprises a cylindrical body of lesser length than that of the cap 10. The sleeve 40 is provided with a central bore 43 extending between opposite open ends 42 and 44. A rectangular cutout 45 extends through the wall of the sleeve 40. Longitudinally extending ribs 47 are formed at circumferentially spaced intervals on the inner surface of the sleeve. In the embodiment shown in FIGS. 7 and 8, several longitudinal ribs 47 are provided at equally spaced circumferential intervals along the entire length of the sleeve. The upper end 44 of the sleeve is provided with an inturned, transversely extending, annular flange 48 which projects inwardly about a central annulus 49.

Figure 16:
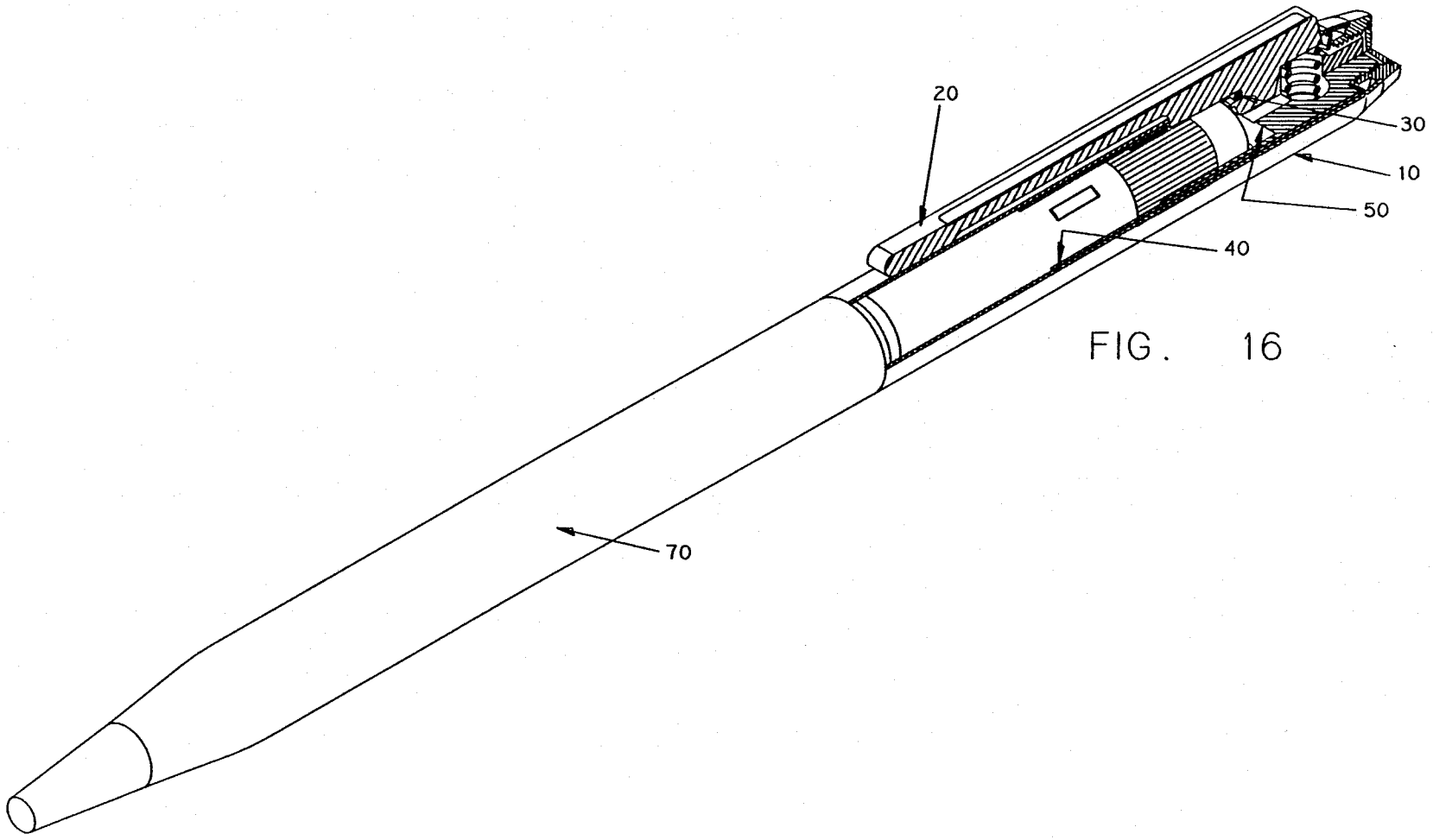
FIG. 16 is a perspective view of a writing instrument, partially broken away, which embodies a writing instrument cap assembly of the present invention.
Figure 17:
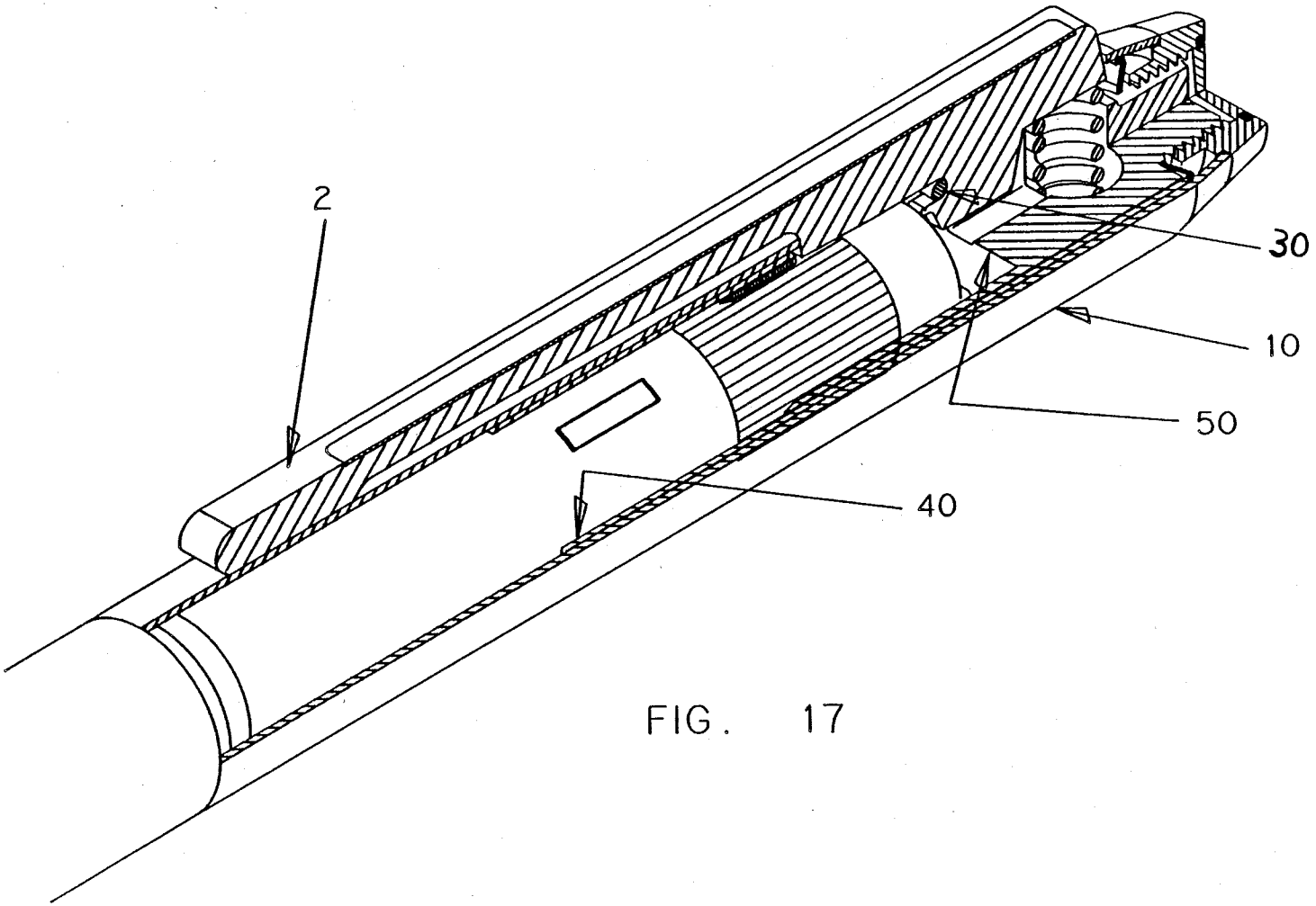
FIG. 17 is an enlarged view of the upper end of the writing instrument of FIG. 16.
Figure 18:
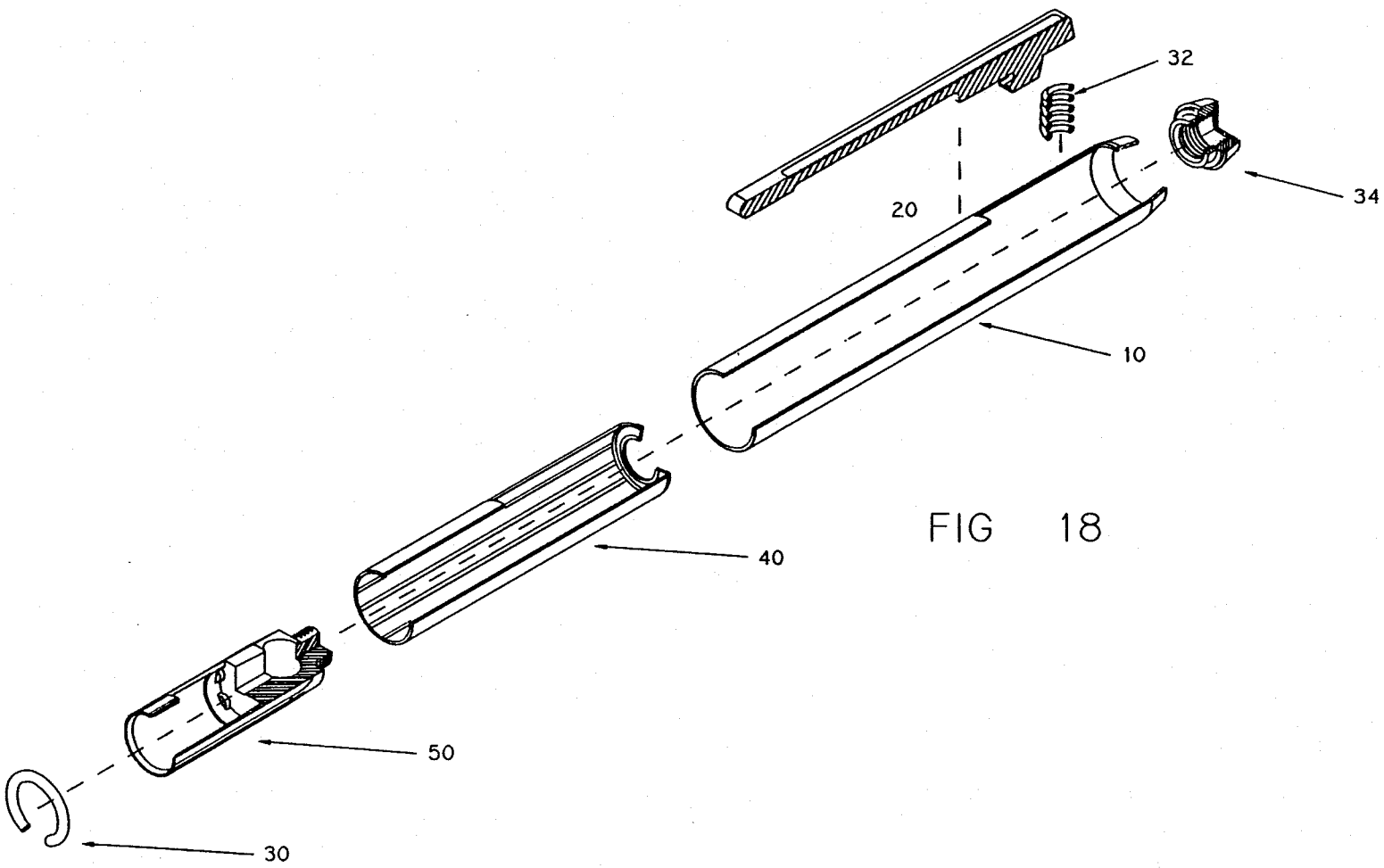
FIG. 18 is an exploded perspective view, partially in section, illustrating various components of a writing instrument cap assembly arranged according to the invention.

The ribbed sleeve 40, as shown by FIGS. 16 and 17, is a frictional device that drives a pen/pencil mechanism and also retains the cap to barrel assembly 70. The ribbed sleeve 40 is pressed into the cap and against a taper at its upper end which provides a location stop for the pivot insert as described hereafter in more detail. It also encapsulates the pivot insert 50 and ring 30, adding strength to these parts. An anti-rotational effect produced between the inner surface of the ribbed insert 40 and the outer surface of the pivot insert 50. This effect benefits both parts.

The pivot insert 50 is a cylindrical plastic plug which is designed to be closely received within the bore 43 of the ribbed sleeve 40. Longitudinally extending grooves 62 are formed at circumferentially spaced intervals on the outer surface of the insert. The pivot insert 50 includes a transverse spring receiving hole 51 for receipt of the compression spring 32 and an axial slot 53 above a pivot ring backstop 58. The slot 53 provides a recess for the receipt of the hook 28. A central axial hole extends from the lower end 52 of the insert 50 for a distance of approximately one half of the length of the insert 50. The axial hole has a stepped inner surface providing dual bores, i.e. a lower bore 55 of a first inner diameter and an upper bore 57 having an inner diameter of lesser dimension than that of the lower bore 55. The upper end portion of the insert 50 terminates in a boss 54. The overall length of the insert 50 is smaller than that of the sleeve 40. A flat 60 is formed on the surface of the pivot insert 50 at the outermost edge of the spring receiving hole 51 and axial slot 53. The flat 60 is formed on an inclined angle relative to the longitudinal axis of the insert 50. The angle of the flat portion 60 toward the upper end 56 provides a stop for the rotary pivotal movement of the clip 20. The smaller angle of the flat portion 60 toward the end 52 provides clearance for size variations of the bottom portion 26 of the clip 20. In the preferred embodiment, the flat 60 is formed at two angles with a flat portion at the lower end of the insert 50 having a smaller angle relative to the longitudinal axis than a flat portion at the upper end. The pivot insert 50 is preferably a plastic having high wear and low creep characteristics such as the polyacetals.

Protuberances 61 are provided on the backstop 58 for initial seating of the pivot ring 30. The protuberances 61 project axially from the backstop 58 toward the lower bore 55.

Figure 19:
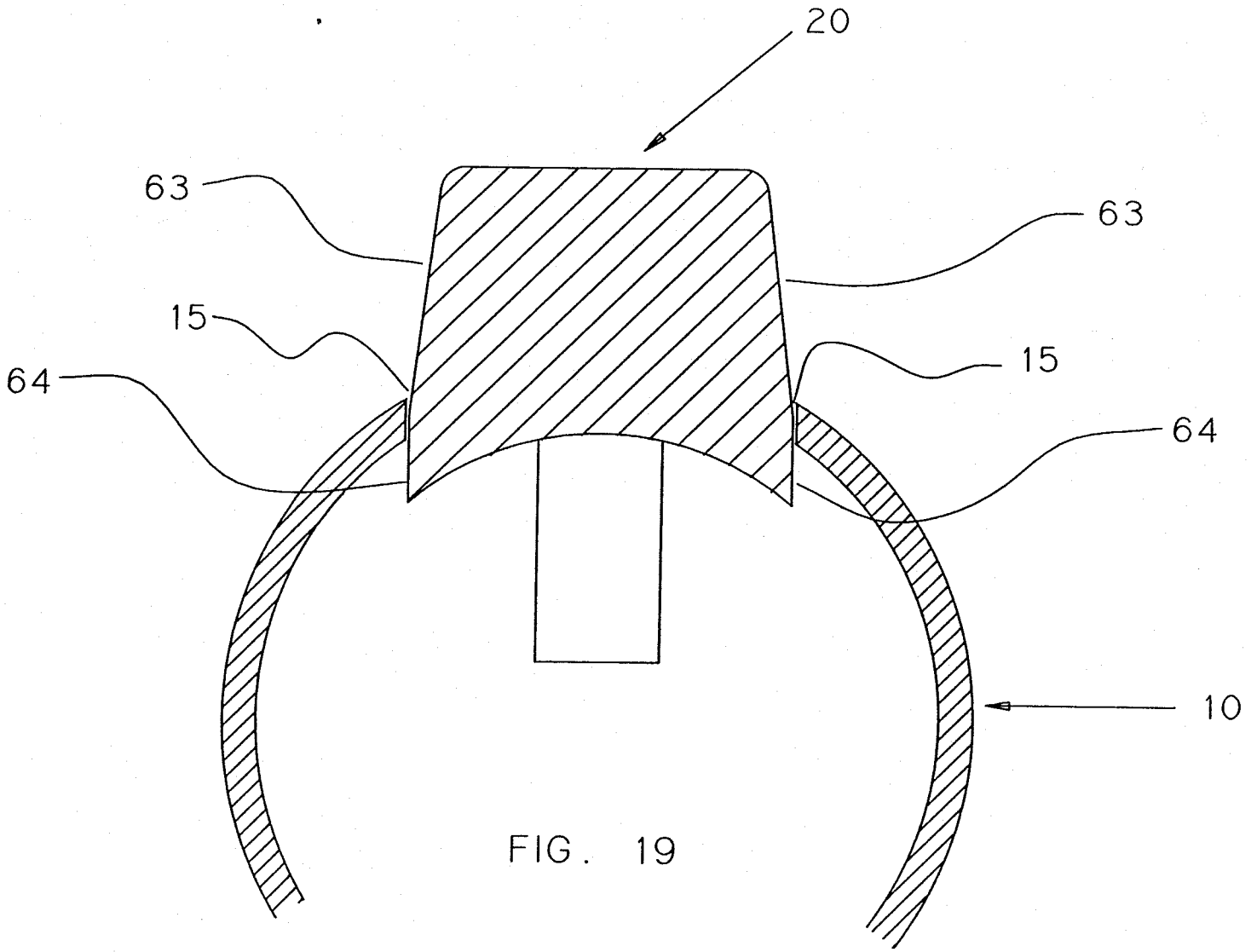
FIG. 19 is an enlarged cross-sectional view showing the taper of the sides of the clip in accordance with a preferred embodiment of the invention.

As best shown in FIG. 19, the sides the clip 20 are tapered to reduce scratching during operation. The outer most portion of the clip, on each side, is provided with a surface 63 having a first angle which is visible after assembly. A second inward surface 64, on each side of the clip, has a second angle. The tapered portion 63 of the sides of the clip on the upper end 27 of the clip moves down into the cap when the lower end 23 of the clip is raised from the cap surface. During the movement of the taper 63 provides clearance to the sides of the clip and reduces scratching on the side of the clip. The straight portion 64 serves to locate accurately the clip within the slot in the cap side-to-side while also keeping the clip aligned straight on the cap.

In order to assemble the writing instrument cap assembly of the invention, the ribbed sleeve 40 is first axially advanced into the cap 10 and press fitted adjacent the upper end 14 against the taper of the upper end portion 16 of the cap 10.

The pivot insert 50 is then press fitted into the ribbed sleeve 40 with the upper end shoulder 56 abutted up against annular flange 48 and with the boss 54 projected through the annulus 49. The spaced, longitudinal ribs 47 of the sleeve 40 are interlocked with the longitudinal grooves 62 and the outer surface of the plastic insert 40 and act to produce an anti-rotational effect. The axial slot 53 and spring receiving hole 51 of the pivot insert 50, are aligned with the rectangular slot 15 of the cap 10 and the rectangular cutout 45 of the ribbed sleeve 40. The axial slot 53 is dimensioned to provide laterally close clearances between the sides of hook 28 and the sides of the insert 50 adjacent to the axial slot 53.

The insert 50 is fastened in place by attaching the top 34 to the boss 54. The top 34 is a decorative nut which is engaged with the boss 54 and abutted against the upper end 14 of the cap to secure the internal parts of the cap assembly. In a preferred embodiment of the invention, the top 34 and the boss 54 are threaded and threadably engaged to each other. Alternatively, the top and boss can be attached to each other by ultrasonic welding, by an adhesive interconnection, by use of staking or a push-nut connection or by other known means.

The compression spring 32 is then laterally inserted through the rectangular slot 15 and axial cutout 45 into the spring receiving hole 51. The spring 32 is located at a predetermined position beyond the pivot point of the clip 20, that is, between hook 28 and the top end 27 of the clip 20. It develops the desired preload force when the clip 20 is urged against the cap 10 and the proper spring rate when the clip 20 is deflected.

Next, the clip 20 is properly positioned on the cap 10 relative to the cap 10 and the rectangular slot 15. The bottom projection 26 is extended in the rectangular slot 15 with the hook 28 guided into the axial slot 53. At this point, the clip 20 is ready to be fastened to the rest of the assembly by the pivot ring 30.

Figure 20:
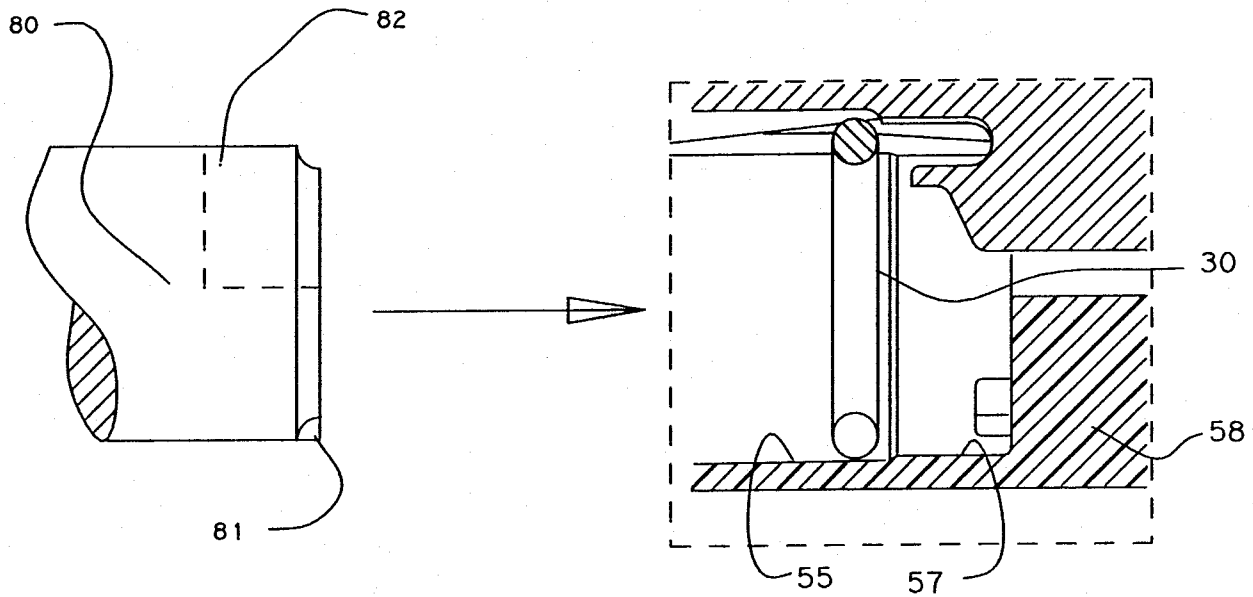
FIG. 20 is an exploded view showing an arbor for inserting a ring into the plastic insert.

The pivot ring 30, which is preferably a split ring, is then axially inserted into the partially completed assembly from the lower end 12. The pivot ring 30 is received in the upper bore 57 and partially engaged within the hinge groove 25 of the hook 28. Preferably, the pivot ring 30 is aligned and placed within the lower bore 55 of the pivot insert 50 prior to the introduction of an ultrasonic horn. This is accomplished, as shown in FIG. 20, with an arbor 80 having a reciprocal shape to that of the ring 30, and a key 81 within the arbor that locates the split portion of the ring 30, opposite that of the hook portion of the clip. A slot 82 provides a clearance for the clip hook 28. The ring 30 is then ready to be contacted by the ultrasonic horn, and inserted to a predetermined distance. Within the stroke of that distance, ultrasonic energy is triggered, and conducted through the horn and into the ring itself by known techniques. The amount of energy, distance, pressure, and time is adjustable.

The function of the pivot ring 30 is to provide an axis on which the clip 20 rotates and to retain the clip 20 in the proper location. The pivot ring 30 is unique in its function as a hinge in comparison to a straight pin for several reasons. First, the ring 30 locates the pivot point close to the outside diameter of the writing instrument without sacrificing strength since the stresses on the axes are transmitted to the ribbed sleeve and the cap 10. Second, the protrusion of the hook 28 from the bottom of the clip 20 can be much less and, therefore, it can be cold drawn in a coining operation. This reduces the complexity of the clip 20. This also reduces the required size of the slot 53 in the pivot insert 50 and increases the strength of the insert. The diameter of the ring 30 is also compliant to inner diameter variations of the pivot insert 50. The ring 30 can be inserted into a completed assembly and be ultrasonically seated into an exact location regardless of the prior assembled parts. This ability to absorb a tolerance build-up is desirable for minimal clearances between the walls slot 15 of the cap and upper portion 26 of the clip 20.

Figure 11:
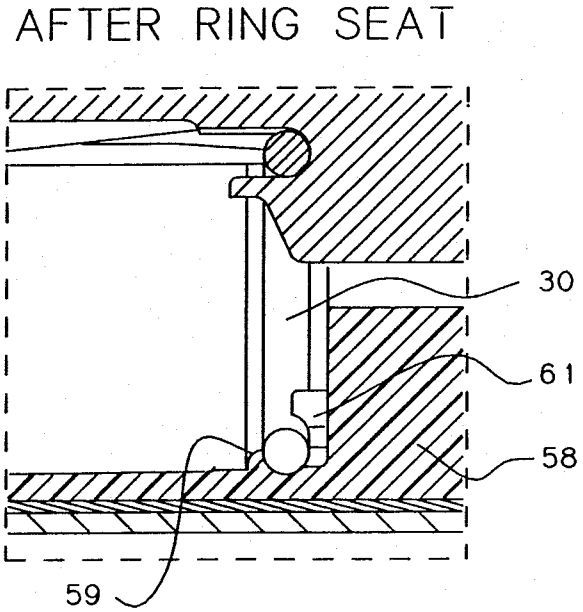
FIG. 11 is an enlarged fragmentary section showing a pivot ring embedded in the plastic pivot insert, according to the invention, after the ring has been seated.
Figure 12:
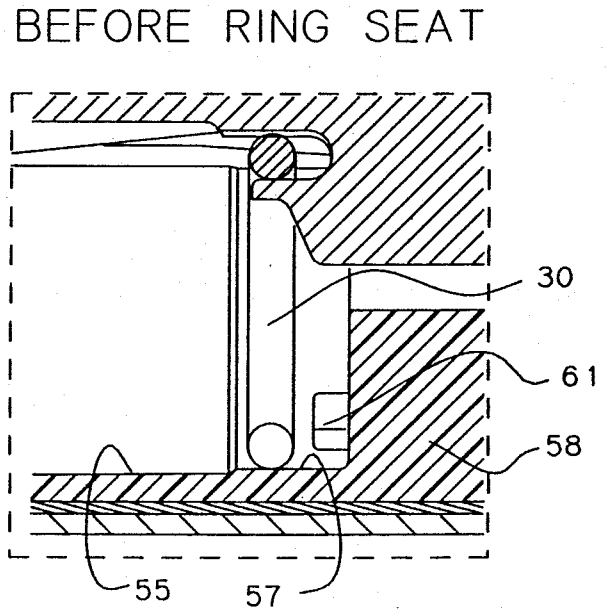
FIG. 12 is an enlarged fragmentary section showing a pivot ring arranged within the plastic insert, according to the invention, before the ring is seated.
Figures 13, 14, 15:
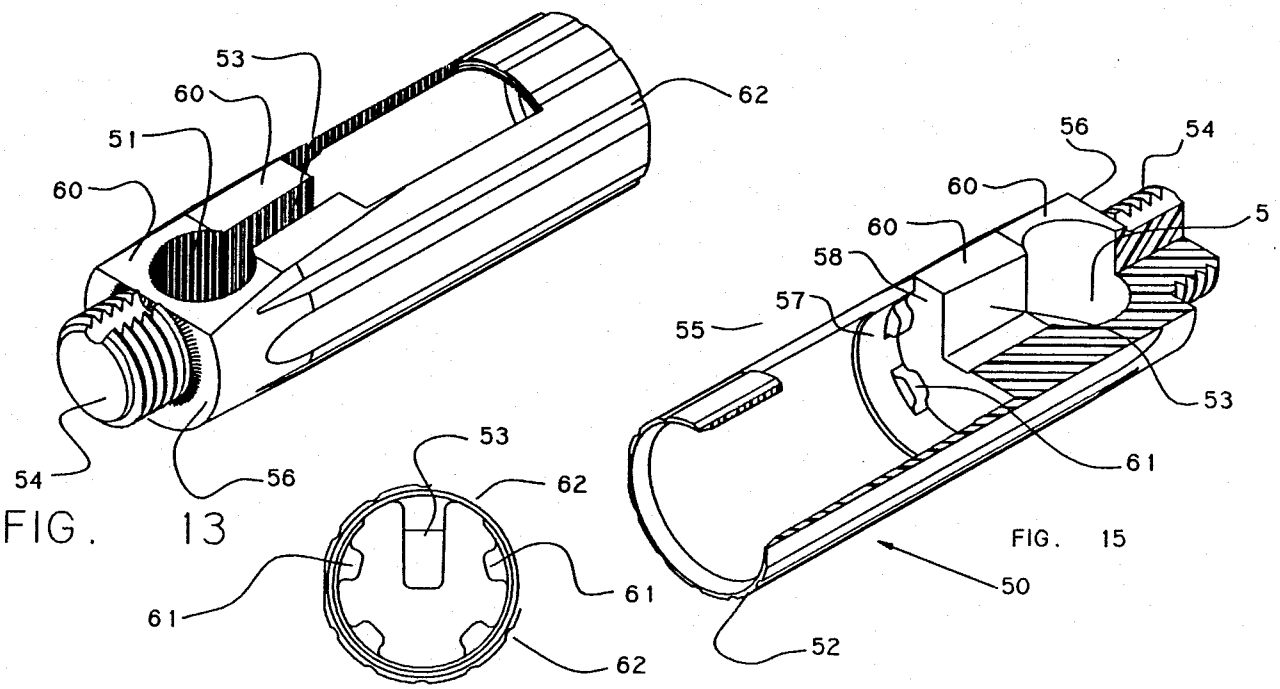
FIG. 13 illustrates a perspective view of the pivot insert of FIG. 9.
FIG. 14 shows an end view of the pivot insert of FIG. 9.
FIG. 15 illustrates a perspective view of the pivot insert of FIG. 9, partially broken away, viewed from the end opposite that shown in FIG. 13.

The ring 30 is ultrasonically welded into the protuberances 61 until the portion of the ring 30 in the groove 25 is seated, i.e., abutted to the base of the hook 28. The pivot ring 30 creates its own seat on being ultrasonically welded to the protuberances by the material of the upper bore 57 and the protuberances 61, as shown in FIG. 11, to the ring to permanently fix the ring 30 in place. The lip 29 may then be mechanically struck to form a loop around the pivot ring to further restrain ring 30 from any possible movement. The ring 30 also acts as a stabilizer by restraining lateral movement of the hook 28 in the axial slot.

Thus, the location of the ring is not predetermined relative to the parts of the assembly, for example, by a machine groove in the insert, nor is the accurate location and precision movement of the clip 20 dependent upon an exact location of the internal parts to which the clip is fastened. The described assembly technique and structural arrangement allows the clip to exactly be positioned in an exact relation relative to the rectangular hole of the cap. Therefore, differences in the cumulative tolerances of the different parts of different cap assemblies are accounted for by the placement and affixing of the ring, after the parts have been assembled in a precise relationship to each other, so as to maintain the parts in said relative relationship.

The hidden pivot of the present invention enhances the jewelry-styled appearance of the writing instrument. The design of the clip is intended to compliment the overall appearance of the writing instrument. It has a machined or heavy look while maintaining a low profile.

In operation, the location of the pivot point permits the top portion of the clip to be depressed into the cap which raises the lower end of the clip 20 off of the cap 10. It is possible to lift the lower end of the clip 20 up as well as depressing the top end. This action permits easy insertion of the writing instrument into a shirt pocket or a thick tweed sportcoat. The compression of the spring 32 against its stop beneficially provides the user with an indication of the limit of normal travel. Additional deflection, available in the clip itself, provides an added safety factor which further minimizes the possibility of over-extending and breaking of the clip mechanism.

When the clip 20 is pivotably deflected, part of the top portion of the clip 20 is depressed into the cap 10 and part of the clip 20 rises out of the cap 10. The construction of the present invention provides the ability to replace a damaged clip or spring. By removing the pivot ring, the damaged parts can be removed from the cap. A new part can be reassembled to the cap by repositioning the pivot ring back into the pivot insert. The ring will snap back into the existing groove created in the pivot insert when the cap was originally assembled.

The invention claimed is:

1. A writing instrument cap assembly comprising:

a tubular body with a wall portion having a wall slot extended through the wall portion from the outside surface to the inside surface of the tubular body;

an elongated pocket clip arranged longitudinally to the tubular body and having a bottom projection at a first end, said bottom projection being projected through the wall slot from outside of the tubular body, and said clip having a bottom stop at a second end opposite the first end, said stop overlying the outside surface of the tubular body;

an insert coextended within at least a portion of the tubular body, said insert including an axial slot transversely aligned with said wall slot and said insert including a transverse hole;

the bottom projection including a hook extended into said axial slot, said hook including a groove;

a ring within said insert and engaged in said groove;

resilient means mounted in said hole against said pocket clip in a position between said hook and the first end for biasing the clip about the ring into a position in which the clip is substantially parallel to the tubular body and with the bottom stop being urged toward the tubular body; and said insert comprising integral means for locating said ring in a predetermined position in said insert, said insert comprising a cylindrical plastic plug including an axial bore for receiving the ring and said integral means comprising a plurality of protuberance located at circumferentially spaced positions with said bore.

2. A writing instrument cap assembly comprising:

a tubular body with a wall portion having a wall slot extended through the wall portion from the outside surface to the inside surface of the tubular body;

an elongated pocket clip arranged longitudinally to the tubular body and having a bottom projection at a first end, said bottom projection being projected through the wall slot from outside of the tubular body, and said clip having a bottom stop at a second end opposite the first end, said stop overlying the outside surface of the tubular body;

an insert coextended within at least a portion of the tubular body, said insert including an axial slot transversely aligned with said wall slot and said insert including a transverse hole;

the bottom projection including a hook extended into said axial slot, said hook including a groove;

a ring within said insert and engaged in said groove;

resilient means mounted in said hole against said pocket clip in a position between said hook and the first end for biasing the clip about the ring into a position in which the clip is substantially parallel to the tubular body and with the bottom stop being urged toward the tubular body; and a tubular sleeve mounted within the tubular body intermediate the inside surface of the tubular body and the insert, said sleeve including a rectangular cutout transversely aligned with said wall slot and said axial slot.

3. A writing instrument cap assembly as recited in claim 2 wherein said bottom stop includes an arcuate surface complementary to the outside surface of the tubular body.

4. A writing instrument cap assembly a recited in claim 2, wherein said insert comprises integral means for locating said ring in a predetermined position in said insert, said ring being at least partially within said integral means for retaining said ring in a fixed position.

5. A writing instrument cap assembly as recited in claim 2, wherein said insert comprises integral means for locating said ring in a predetermined position in said insert, said ring being mounted up against said integral means for locating said ring.

6. A writing instrument cap assembly as recited in claim 2, wherein said sleeve comprises an inner circular surface which includes a plurality of longitudinally extending ribs, and wherein said insert includes an outer surface having longitudinally extending grooves, one of each of said ribs being engaged within one of each of said grooves.

7. A writing instrument cap assembly as recited in claim 6, said ribs formed at a circumferentially spaced intervals.

8. A writing instrument cap assembly as recited in claim 9, said ribs comprising a multiplicity of ribs at equally spaced circumferential intervals.

9. A writing instrument cap assembly as recited in claim 2, wherein said wall slot comprises a slot having opposite parallel sides.

10. A writing instrument cap assembly as recited in claim 2, wherein said wall slot comprises a rectangular slot.

11. A writing instrument cap assembly as recited in claim 2, wherein said resilient means comprises a compression spring.

12. A writing instrument cap assembly as recited in claim 11, wherein said sleeve comprises an inner circular surface which includes a plurality of longitudinally extending ribs frictionally engaged with said insert.

13. A writing instrument cap assembly as recited in claim 12, wherein the ribs comprises a plurality of ribs formed at circumferentially spaced intervals.

14. A writing instrument cap assembly comprising:

a tubular body with a wall portion having a wall slot extended through the wall portion from the outside surface to the inside surface of the tubular body;

an elongated pocket clip arranged longitudinally to the tubular body and having a bottom projection at a first end, said bottom projection being projected through the wall slot from outside of the tubular body, and said clip having a bottom stop at a second end opposite the first end, said stop overlying the outside surface of the tubular body;

an insert coextended within at least a portion of the tubular body, said insert including an axial slot transversely aligned with said wall slot and said insert including a transverse hole;

the bottom projection including a hook extended into said axial slot, said hook including a groove;

a ring within said insert and engaged in said groove;

resilient means mounted in said hole against said pocket clip in a position between said hook and the first end for biasing the clip about the ring into a position in which the clip is substantially parallel to the tubular body and with the bottom stop being urged toward the tubular body; and said insert being composed of plastic and said ring being ultrasonically embedded within said insert.

15. A writing instrument cap assembly as recited in claim 14 further comprising means for fixing said insert to said tubular body.

16. A writing instrument cap assembly as recited in claim 14, wherein said ring comprises a split ring.

17. A writing instrument cap assembly comprising: a tubular body having a rectangular slot, a sleeve press-fitted into the tubular body, the sleeve having a rectangular cutout transversely aligned with the rectangular slot, a plastic insert inserted into the sleeve with an axial slot transversely aligned with the rectangular cutout, said plastic insert including an axial bore of circular cross-section communicating with said axial slot, and a ring mounted in the axial bore adjacent the axial slot, a pocket clip including a projection arranged longitudinally on the outside of the tubular body projected partially through the rectangular slot and the cutout, and the projection including a hook having a hook groove, the ring being received in the hook groove and embedded in the insert, and resilient means in the insert engaged with the projection for biasing the clip to a neutral position.

18. A method of assembling a writing instrument cap assembly of the type having a cap with a hollow tubular body with a wall slot extending through a wall portion, the cap having a bore extended between a first open end and a second open end, and a tapered portion adjacent the second open end, the method comprising the steps of:

providing an insert including an axial slot and a hole extending transversely of the longitudinal axis of the axial slot;

inserting the insert into the bore of the tubular body with a portion of the insert extended beyond the second open end;

aligning the axial slot transversely with the wall slot;

inserting a spring transversely through the wall slot into the hole;

mounting a pocket clip on the cap with a portion transversely extended through the wall slot into the axial slot, the portion including a hook having a hook groove;

axially inserting a ring into abutment with the insert and a portion thereof being received in the hook groove; and embedding the ring into the insert.

19. A method as set forth in claim 18, wherein said embedding step comprises ultrasonically the ring into the insert.

20. A method as set forth in claim 19, further comprising providing a sleeve having an axial bore, said sleeve having an axial cutout; inserting the sleeve into the bore of the tubular body before inserting the insert; and then inserting the insert into the sleeve; and transversely aligning the axial cutout with the wall slot and the axial cutout.

21. A method as set forth in claim 20, further comprises the step of fixing the insert relative to the cap prior to the embedding step.

* * * * *